US005295267A

United States Patent [19]

Galindo

[11] Patent Number: 5,295,267

[45] Date of Patent: Mar. 22, 1994

[54] PROTECTIVE LOINCLOTH GARMENT FOR MOTORCYCLE RIDERS

[76] Inventor: Stephanie D. Galindo, 120 Barranca -B, Santa Barbara, Calif. 93109

[21] Appl. No.: 6,033

[22] Filed: Jan. 19, 1993

[51] Int. Cl.[5] ..... A41D 13/00

[52] U.S. Cl. ..... 2/2; 2/23; 2/46; 2/48; 2/51; 2/214; 2/242

[58] Field of Search ..... 2/2, 22, 23, 46, 47, 2/48, 50, 51, DIG. 5, 242, 214, 87, 311, 317, 318, 319, 336, 338

[56] References Cited

U.S. PATENT DOCUMENTS

| | | | |
|---|---|---|---|
| 1,062,697 | 5/1913 | Daum | 2/51 |
| 1,281,299 | 10/1918 | Crosson . | |
| 1,406,225 | 2/1922 | Rathsmill | 2/46 |
| 1,413,290 | 4/1922 | O'Leary . | |
| 1,468,072 | 9/1923 | Ogle | 2/23 |
| 1,660,342 | 2/1928 | Levinson | 2/2 |
| 1,720,439 | 7/1929 | Richardson | 2/2 |
| 1,723,831 | 8/1929 | Weymouth . | |
| 2,266,886 | 12/1941 | McCoy . | |
| 2,637,032 | 5/1953 | Pinsuti | 2/23 |
| 2,754,532 | 7/1956 | Kanehl et al. . | |
| 3,062,580 | 11/1962 | Jasmin, Jr. . | |
| 3,212,690 | 10/1965 | Green . | |
| 3,683,910 | 8/1972 | McKenna . | |
| 4,028,740 | 6/1977 | Luerken . | |
| 4,987,610 | 1/1991 | Hunt | 2/51 |

FOREIGN PATENT DOCUMENTS

| | | | |
|---|---|---|---|
| 3529080 | 4/1987 | Fed. Rep. of Germany | 2/2 |
| 2500200 | 8/1982 | France | 2/2 |
| 2624354 | 6/1989 | France | 2/2 |
| 802719 | 10/1958 | United Kingdom | 2/46 |

*Primary Examiner*—Clifford D. Crowder

*Assistant Examiner*—Gloria Hale

[57] ABSTRACT

A protective loincloth garment as shown in FIG. 1 and generally referred to as 30, serving to shield and insulate the sensitive groin and inner thighs from cold, wind, and wet weather while the wearer sits astride a motocycle. An aesthetic, comfortable, flexible, insulated, wind and weather resistant protective garment that depends in front of the groin and inner thigh areas by means of suspensory straps 10 placed so as to not interfere with the functioning of conventional belt, chaps or clothing. The garment 30 is partially or fully detachable from conventional chaps, belt or belt loops by means of a plurality of decorative or simple fasteners 16–18 attached to the suspensory straps 10. The terminals of the suspensory straps 10 pass over a belt or through belt loops and then secure to the protective garment body 50 by coupling the fasteners 16–18. The protective garment 30 is of a length L to securely tuck between the legs.

The body of the protective loincloth garment 30 is composed of a wind and weather resistant outer surface 12, such as leather, and a comfortable and insulating inner surface (illustrated in FIGS. 2, 3 and 5) such as fleece. These surfaces are bonded together by a flexible, temperature and water resistant cement, glue or adhesive (best illustrated in FIG. 3). For added durability, decorative or simple rivets 20 further secure the outer and inner surfaces together. This forms the garment body 50.

The protective garment 30 may include one or more pockets with or without fastenings or closures and/or non-functional embellishments, and/or appendages which tuck into the upper thigh area of loose fitting chaps (illustrated in FIG. 6).

5 Claims, 4 Drawing Sheets

PROTECTIVE LOINCLOTH GARMENT FOR MOTORCYCLE RIDERS

BACKGROUND

1. Field of Invention:

The protective loincloth garment relates to protective outer garments specifically shielding and insulating the groin and inner thigh areas from cold, wind and wet weather while the wearer operates a motorcycle.

2. Area of Search

In addition to key word searches by Mead Data Central and myself at the Sunnyvale Patent Depository, I searched the entire Class 2 Subclass 2. This search was conducted at the Sunnyvale Patent Depository, University of california at Santa Barbara Government Documents Library, and the Los Angeles Public Library Patent Depository.

| Patents Referenced: | | |
|---|---|---|
| U.S. Pat. No. 1,660,342 | D. Levinson | 1928 |
| U.S. Pat. No. 1,720,439 | W. Richardson | 1929 |
| U.S. Pat. No. 2,266,886 | A. M. McCoy | 1941 |
| U.S. Pat. No. 3,682,910 | W. J. McKenna | 1972 |
| U.S. Pat. No. 4,028,740 | A. Luerken | 1977 |
| U.S. Pat. No. 1,281,299 | A. Crosson | 1918 |
| U.S. Pat. No. 1,413,290 | J. B. O'Leary | 1922 |
| U.S. Pat. No. 2,754,532 | L. H. Kanehl, et al | 1956 |
| U.S. Pat. No. 1,723,831 | C. R. Weysmouth | 1929 |
| U.S. Pat. No. 3,062,580 | R. M. Jasmin | 1962 |
| U.S. Pat. No. 3,212,690 | J. B. Green | 1965 |

OBJECTS AND ADVANTAGES

There are no protective outerwear garments that securely shield and insulate the groin and inner thigh areas from cold, wind, and wet weather. The protective loincloth garment for motorcycle riders addresses an existing need and solves a problem for which no solutions have been recognized.

Motorcyclists often wear leather chaps for protection from cold, wind and wet weather. Chaps leave the groin and inner thigh areas completely unprotected. These sensitive areas become cold easily, especially when wet, causing great discomfort. This is especially true under hazardous driving conditions. Discomfort is known to cause stress, fatigue and inattention while operating a motor vehicle, leading to unfortunate accidents.

Many people utilize motorcycles and scooters as a sole method of transportation to work or school. These people are often subject to severe weather. Even those who wear leather riding pants or other protective riding clothing may find that the button or zipper closures allow wind and wet weather to penetrate sensitive areas. The protective loincloth garment for motorcyclists is designed to be versatile so that it is useful with a wide range of riding garments.

Accordingly, it is the primary object of this protective garment to securely shield and insulate the groin and inner thigh areas from cold, wind and wet weather. It is an object of the protective garment that the entire garment shall be treated with an appropriate water-resistant substance, and shall be bonded between shielding and insulating surfaces with a water resistant adhesive.

Another object is that the garment be easily partially or fully detachable when not in use. The garment could be partially or fully detached when the wearer buckles a conventional belt or chaps, or when the wearer attends the toilet. The garment may also be fully detached when warm, dry weather provides greater riding comfort.

Another object is that the protective garment functions without material structural changes to conventional receiving clothing.

It is an additional object that the garment be versatile for use with conventional chaps, conventional belts, and conventional belt loops. Therefor the garment may be worn with chaps, jeans or leather pants, and will function with a wide range of other protective riding clothing.

It is an object of this protective garment that it specifically be functional with different types of chaps, both tight and loose fitting. Women's chaps are usually tight fitting about the upper thigh area. Men's chaps are generally quite loose fitting about the upper thigh area. Thus, two embodiments of the invention are suggested to sufficiently meet the needs of motorcyclists.

Another object is that the protective garment be flexible and plush, not bulky, stiff nor uncomfortable when the user is seated astride a motorcycle. Therefore, the materials of construction shall not include any stiffening structures.

It is another object that the protective garment shall conform to the shape of the body to provide a secure, wind resistant fit while in use.

Another object is that the protective garment be secured to conventional clothing while riding a motorcycle. Thus each embodiment shall require secure fastenings to attach to chaps, belt, or belt loops. Each embodiment will be of sufficient width to prevent air from invading the shielded area, and of sufficient length to prevent the garment from slipping from a secure position while riding.

Another object is that the suspensory straps contain a plurality of fastenings so that the garment may be adjusted vertically for more secure attachment to conventional belt or belt loops.

The greatest advantage of this protective garment is that the motorcycle riders are warmer, dryer, and more comfortable in especially sensitive areas. Riders are more likely to drive safely when insulated as much as possible from cold, wind, wetness, stress and fatigue.

Further objects and advantages of the protective loincloth garment will become apparent from a consideration of drawings and ensuing descriptions.

PRIOR ART

There is no prior art which is directly germane to the protective loincloth garment for motorcycle riders.

U.S. Pat. No. 1,660,342 D. Levinson 1928

This invention was not designed to suspend detachably from a conventional belt or from belt loops, nor to be worn over conventional clothing. It was designed of absorbent materials that would not shield the wearer from cold, wind or wet weather. The invention consists of bulky pads which would be uncomfortable on a motorcycle and which are not designed to provide a wind resistant and secure fit about the groin area while the wearer is seated. Its functions are contrary to the purpose of my invention.

U.S. Pat. No. 1,720,439 W. Richardson 1929

This invention was not designed to suspend detachably from a conventional belt or from belt loops, nor to be worn over conventional clothing. It would not shield nor insulate the wearer from cold, wind and wet weather. It appears to be designed for activities in a standing position, and may not provide a secure, wind resistant fit in a seated position. The invention is of a bulky design and is constructed of rigid materials for the purpose of deflecting heavy blows. This would be very uncomfortable on a motorcycle.

U.S. Pat. No. 2,266,886 A. M. McCoy 1941

This invention was not designed to suspend detachably from a conventional belt or from belt loops, nor to be worn over conventional clothing. It was designed of absorbent materials that would not shield nor insulate the wearer from cold, wind or wet weather. The invention consists of bulky pads which would be uncomfortable on a motorcycle and which are not designed to provide a secure, wind resistant fit about the groin and inner thigh area while seated. One object of this invention is that it provide good ventilation which is in specific contrast to my purposes. This invention requires the modification of conventional clothing or the addition of fastenings, such as suspensory straps, or the use of adhesive tape in order to be held securely in place. These problems are overcome by my invention.

U.S. Pat. No. 3,683,910 W. J. McKenna 1972

FIG. 13 represents the most applicable reference to my invention. This invention was never intended to be worn over street clothing as it is secured in place by the extension of the penis through a vertical opening in the garmet. The material composition provides no padding or insulation, and its absorbency is in direct contrast to my purposes.

U.S. Pat. No. 4,028,740 A. Luerken 1977

FIG. 3 represents the most applicable reference to my invention. This swimwear garment was never intended to be worn over street clothing, nor is it suspended detachably from a conventional belt or belt loops. The lightweight, absorbent materials provide no padding or insulation or water resistant treatment, and would not protect the wearer from cold, wind or wet weather. Construction would neither be durable nor would the garmet be wind resistant if used for my purposes. Therefor, the purpose of this garment is contrary to the purpose of my invention.

U.S. Pat. No. 1,281,299 A. Crosson 1918

This device was never intended to function as a protective garment. It offers no padding or insulation, water resistant construction or treatment, nor would it provide for a secure, wind resistant fit if used for my purposes.

U.S. Pat. No. 1,413,290 J. B. O'Leary 1922

This device was never intended to function as a protective garment. It offers no padding or insulation, nor would it provide for a secure, wind resistant fit if used for my purposes. This device is intended for a specific purpose and made in a specific form for that purpose. The form and construction would not function for my purposes.

U.S. Pat. No. 2,754,532 L. H. Kanehl, et. al. 1956

This device was never intended to function as a protective garment. It offers no padding or insulation, nor would it provide for a secure, wind resistant fit if used for my purposes. This device is intended for a specific purpose and made in a traditional form for that purpose. The form and construction would not be durable nor functional for my purposes.

U.S. Pat. No. 1,723,831 C. R. Weymouth 1928

This invention was intended to be folded and secured to a belt when not in use. Further, the intended form of the garment is one that conforms to the shape of the buttocks for functioning as a seat, contrary to the purpose of my invention. While the exterior fabric is waterproof, it is not intended to be durable at highway velocity, nor to fit securely about the body while in use. All of these specificity's would preclude the garment from being functional for my purposes. As will become apparent, my invention addresses these shortcomings.

U.S. Pat. No. 3,062,580 R. M. Jasmin. Jr. 1962

The intended form of the garment is one that conforms to the shape of the buttocks for functioning as a seat which is, again, contrary to the purpose of my invention. While the exterior fabric is waterproof, it is not intended to be durable at highway velocity, nor to fit securely about the body while in use. These specificity's would preclude the garment from being functional for my purposes.

U.S. Pat. No. 3,212,690 J. B. Green 1965

This invention shows a detachable pad 44 intended to insulate and protect the user from hot or rough surfaces upon which the wearer in seated. The intended form of the garment is one that conforms to the shape of the buttocks for functioning as a seat, contrary to the purpose of my invention. The fabric is not intended to be durable at highway velocity, nor to fit securely about the body while in use about the groin area, and is not intended to be water resistant, obstacles all overcome by my invention.

This invention also claims an enlarged pocket 32 which would not function for my purposes. It provides no insulation, water resistant treatment, nor does it conform to the shape of the body to provide a secure, wind resistant fit while riding a motorcycle.

DRAWING—FIGURES

FIG. 1 shows the protective loincloth garment in one preferred embodiment generally shown as 30 from a frontal perspective as the suspensory straps 10 would interact with conventional chaps or belts. Fasteners 16–18 are shown unclasped. The garment body, consisting of a multi-layered generally triangular structure, is shown in FIG. 1 as 50. Decorative or simple rivets are shown as indicated at 20.

FIG. 1A shows the garment 30 from a frontal perspective as the suspensory straps 10 would interact with conventional belt loops.

FIGS. 2, 3 and 5 include textural shading to illustrate type of materials utilized in construction of the protective loincloth garment 30. In FIGS. 2, 3 and 5, the inner surface 14 is illustrated in a manner to suggest a fleece, fur or similar insulating material. In FIGS. 2 and 3, the outer surface 12 and suspensory strap 10 are shaded to illustrate that they are both comprised of a water resistant material such as leather. In FIG. 3, the adhesive substance 13 is shaded to differentiate between its consistency and placement, and that of the outer 12 and inner 14 garment surfaces.

FIG. 2 shows a side view with structural detail of the garment 30 along the length L illustrating suspensory strap 10 connecting to the body 50 of the protective loincloth garment via fasteners such as receiving snap rivets 18. The outer surface 12 and inner surface 14 are bonded together by adhesive, glue or cement 13. Decorative or simple rivets 20 further secure the outer and inner surfaces 12–14 together. Fastenings 16–18 are shown clasped as when the garment 30 is in use.

FIG. 3 shows an enlarged sectional view with structural detail illustrating the manner of connecting a suspensory strap 10 to the body 50 of the protective loincloth garment via fasteners such as receiving snap rivets 18. The outer surface 12 and inner surface 14 are bonded together by adhesive, glue or cement 13. Decorative or simple rivets 20 further secure the outer and inner surfaces 12–14 together. Fastenings 16–18 are shown unclasped.

FIG. 4 shows the protective loincloth garment 30 from a clear frontal perspective independent of conventional clothing. The outer protective surface of the garment 30 is shown as 12. Fasteners 16–18 are shown unclasped. The garment body is shown as 50. Decorative or simple rivets are shown as indicated at 20.

FIG. 5 shows the protective loincloth garment 30 from a reverse perspective independent of conventional clothing. The inner insulating surface of the garment 30 is shown as 14. Decorative or simple rivets are shown as indicated at 20.

FIG. 6 shows the protective loincloth garment 30 in a second embodiment as it would interact with conventional chaps. The view in FIG. 6 is from a frontal perspective including structural appendages 22 attached to the garment body 50 at rivets 20 as indicated.

REFERENCE NUMBERS 10 suspensory straps
12 leather or similar material for outer surface shielding
13 glue, cement or adhesive that bonds surfaces 12–14
14 fleece or similar materials for inner surface insulation
16 decorative or simple male snap rivets or fasteners
18 female or receiving snap rivets or fasteners
20 decorative or simple rivets
22 appendages
30 one preferred embodiment of the garment
40 the upper edge of the garment body
50 the garment body itself composed of 12, 13, and 14 as illustrated in a generally triangular structure

DESCRIPTION OF INVENTION FIGS. 1–6—STRUCTURE

FIG. 1 shows a protective loincloth garment in a preferred embodiment generally shown as 30 from a frontal perspective as it interacts with conventional belts or chaps. The protective garment 30 includes a body 50 shown in roughly triangular structure as employed for the purpose of illustrating the application of the invention. The garment body 50 depends from a plurality of suspensory straps 10 attached by receiving snap rivets 18. A plurality of fastenings, such as the corresponding snap rivets 16 at the terminal ends of the suspensory straps 10 couple together with the receiving snap rivets 18. Fasteners 16–18 are shown unclasped.

FIG. 1A shows a protective loincloth garment in a preferred embodiment generally shown as 30 from a frontal perspective as it interacts with conventional belt loops. The suspensory straps 10 shall be of appropriate width so that they may pass easily through conventional belt loops. Fasteners 16–18 are shown unclasped.

FIG. 2 and FIG. 3 The protective garment 30 employed for illustrating the application of the invention shall be comprised of a predetermined thickness of a material, such as leather 12. This material will be securely and completely bonded, as by adhesive or glue or cement 13, to the skin side of a predetermined thickness of a material such as shearling or fleece 14. These surfaces 12–14 will be further secured together by decorative or simple rivets as indicated at 20.

Suspensory straps 10 are attached by fasteners such as receiving snap rivets as indicated at 18. The terminals of the suspensory straps contain a plurality of corresponding fastenings such as decorative or simple snap rivets 16. These fastenings 16–18 are shown in FIG. 2 clasped and in FIG. 3 unclasped.

FIG. 4 shows the protective loincloth garment 30 from a frontal, outer perspective showing surface 12, a predetermined thickness of material such as leather.

Figure 4:
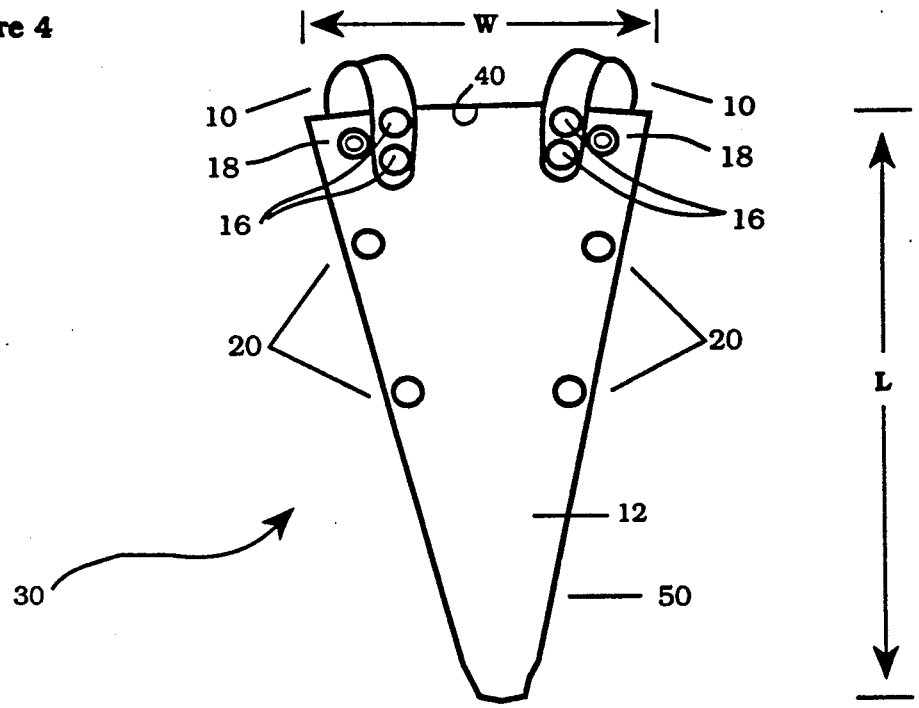
FIG. 4 and FIG. 5 show the protective loincloth garment 30 from frontal and reverse perspectives clearly independent of any clothing.

FIG. 4 shows the garment body 50 in a roughly triangular structure as employed for the purpose of illustrating the application of the invention. It is not desired to limit the invention to any specific form of the body. The garment body 50 shall be of sufficient width W at the upper edge 40 so that suspensory straps 10 will not interfere with the function of conventional chaps or belt buckles. The garment body 50 shall be of sufficient length L so that it may be tucked between the legs of the wearer and sat upon securely and comfortably while astride a motorcycle.

For additional strength and durability, the garment body 50 shall be firmly attached together along the sides by fasteners such as decorative or simple rivets as indicated at 20. FIG. 4 shows the upper edge of the garment body 40 attached to a plurality of suspensory straps 10. The suspensory straps 10 are individually and securely connected to the body of the garment 50 by a fastener, such as a receiving snap rivet 18.

Figure 5:
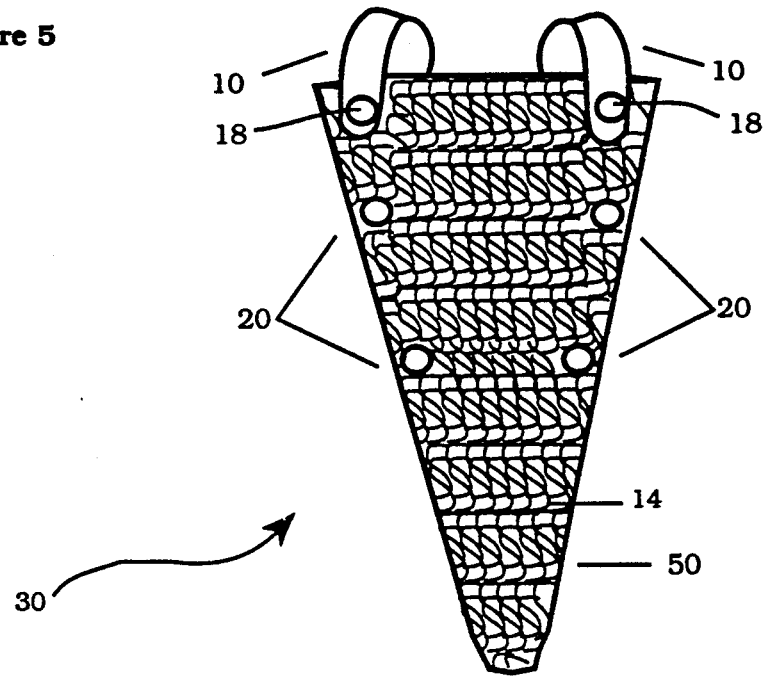

FIG. 5 shows the garment 30 from a reverse perspective showing the inner surface 14, a predetermined thickness of material such as fleece. The suspensory straps 10 are individually and securely connected to the body of the garment 50 by a fastener, such as a receiving snap rivet 18.

Figure 6:
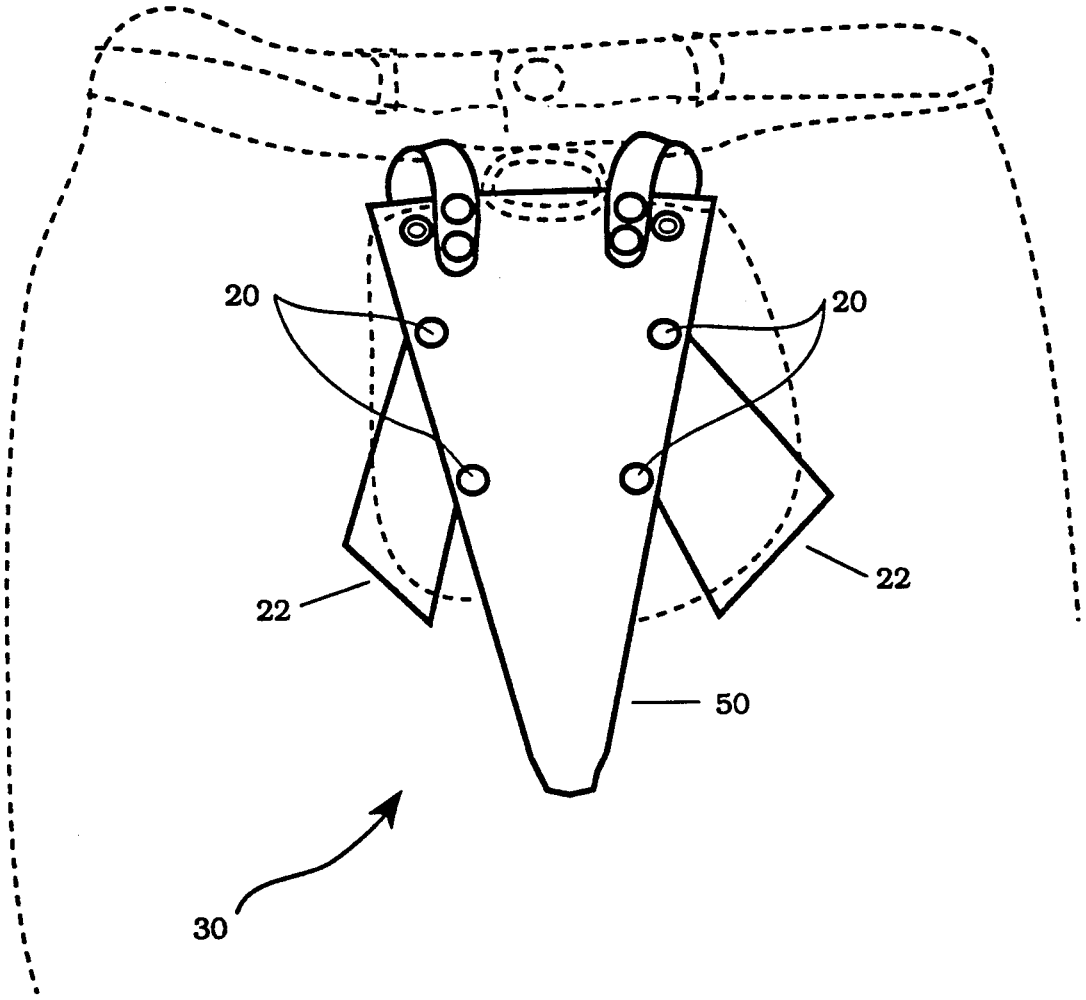

FIG. 6 Another embodiment of the protective garment 30 shall be constructed in exactly the same manner as above, but including the following additions:

A plurality of appendages 22 shall be constructed in the same manner as is the garment body 50. These appendages 22 shall be attached to the garment body 50 as indicated at rivets 20. The appendages 22 tuck inside the upper leg area of loose fitting chaps.

DESCRIPTION OF DRAWING FIGS. 1–6—OPERATION

Figure 1:
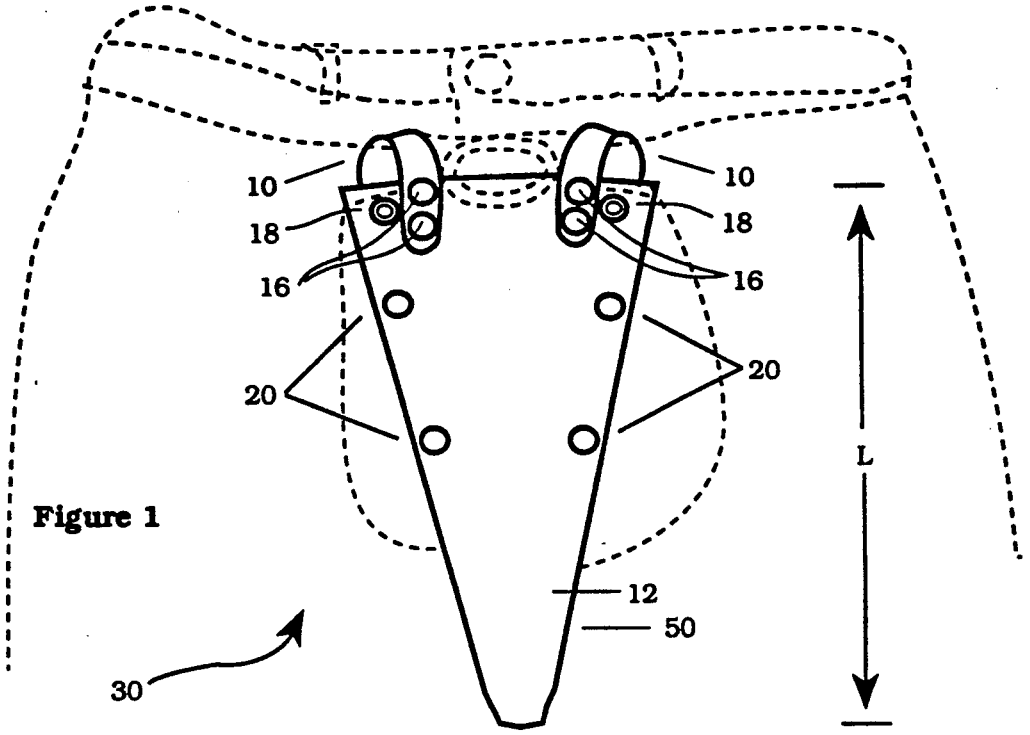
Figure 1A:
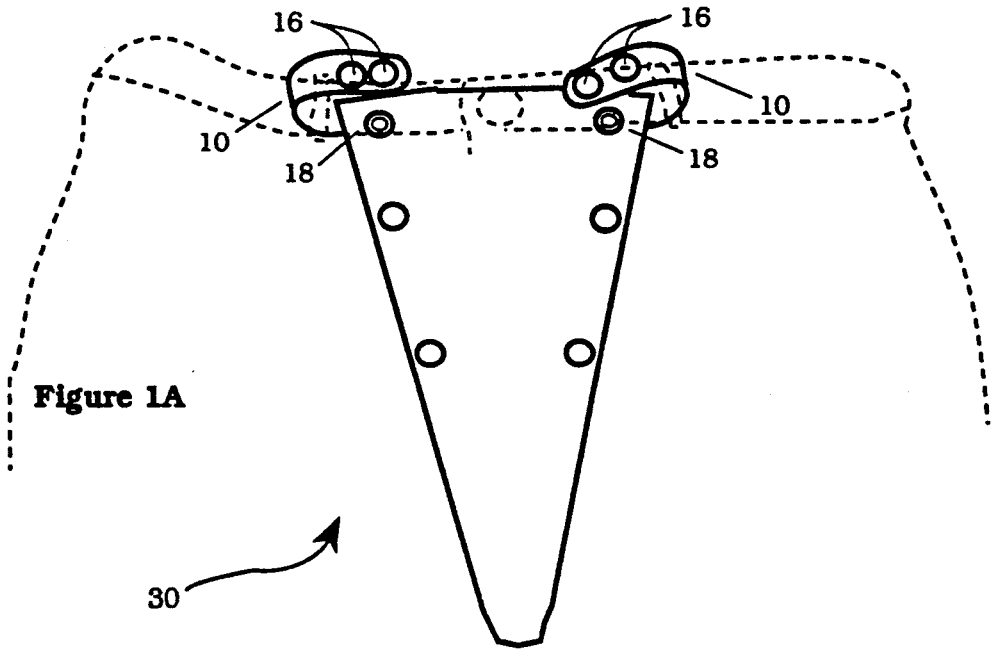

FIGS. 1–1A The protective loincloth garment generally shown as 30 operates as a versatile shield, protecting and insulating the groin and inner thigh areas from cold, wind, and wet weather. The materials used are aesthetic, treated with a water resistant substance, flexible and comfortably padded for ease of use and secure fit; well insulated for warmth and resistance to air flow; and of a predetermined thickness intended to provide functionality, flexibility and durability. Construction is simple and inexpensive.

The protective garment 30 in both embodiments as shown in FIG. 1 and FIG. 6, are designed to be easily partially or fully detachable when attending the toilet, unbuckling chaps or a belt, or when comfortable weather permits removal of the garment 30. Suspensory straps 10 are of a length to easily fold over conventional belts and chap belts as in FIG. 1, and are of a width designed to pass through belt loops as in FIG. 1A. The plurality of decorative or simple snap fasteners 16 are intended to allow vertical adjustment of the suspensory straps 10 upon the belt or belt loops for a secure fit, limiting vertical movement.

The garment 30 is functional with many types of conventional street clothing and protective motorcycle riding clothing. The protective garment 30 in both embodiments will cover and protect the drafty zipper or button closure area of jeans, leather or waterproof pants, or other riding clothes by virtue of being attachable to a conventional belt or belt loops.

Figure 2:
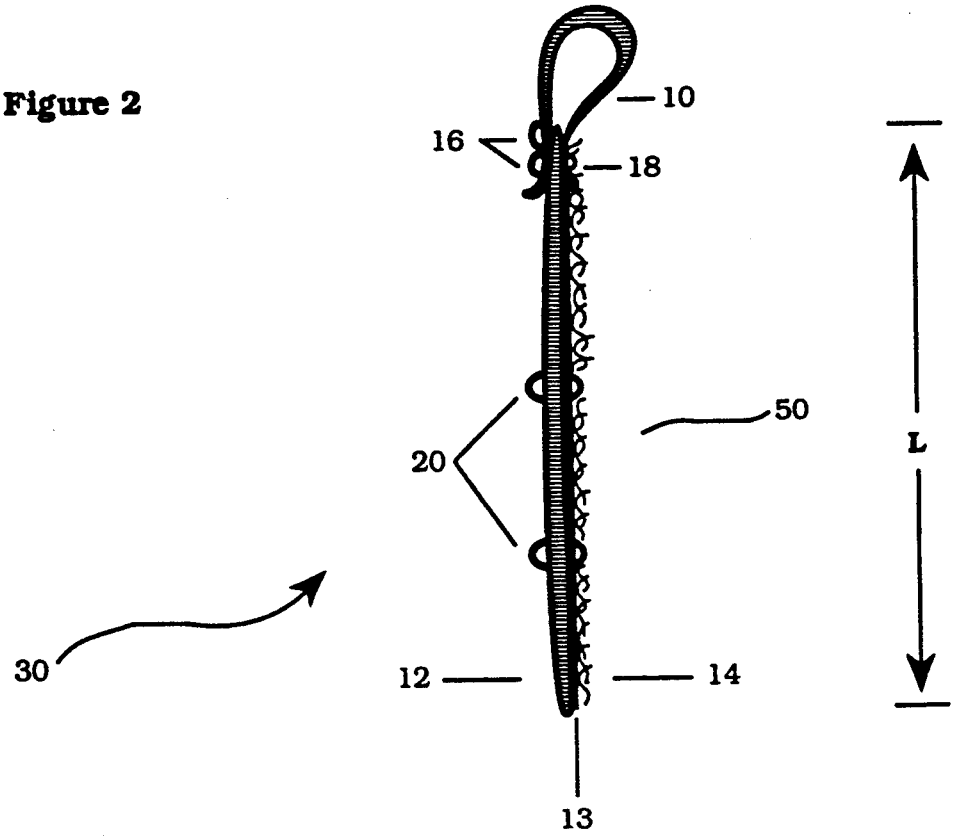
Figure 3:
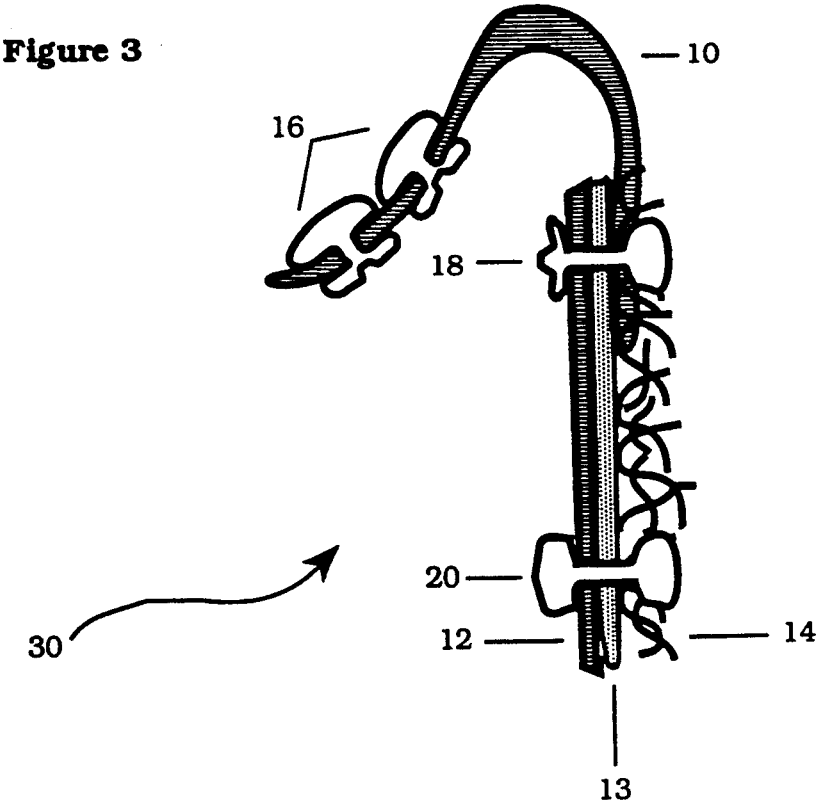

FIG. 2 and FIG. 3 Both embodiments of the protective garment are constructed with cement, glue or adhesive 13 forming a bond between outer surface 12 and inner surface 14. This provides durability and strength, as well as greater water resistance. The predetermined thickness of the outer surface 12 will act as a durable, flexible wind breaker and will repel water. The predetermined thickness of the inner surface 14 will provide padding for comfort and insulation from cold, as well as resistance to airflow. A plurality of decorative or simple snap fasteners 16 are provided at the suspensory strap 10 terminals for attachment to receiving snap rivets 18. These allow for easy adjustment to limit vertical movement relative to the belt or belt loops. FIG. 2 shows these fasteners 16–18 clasped, and FIG. 3 shows the fasteners 16–18 unclasped.

The protective garment is worn with the insulated side 14 facing the human body. The lower end of the garment is tucked between the legs of the wearer and sat upon securely while astride a motorcycle.

FIG. 4 shows the protective garment 30 from outer surface 12, and FIG. 5 shows the inner surface 14. The garment body 50 is illustrated in a roughly triangular structure for showing the application of the invention. The width W of the upper edge 40 of the garment body 50 shall be sufficient so that the suspensory straps 10 do not interfere with the function of conventional chaps or belt buckles. The garment body 50 shall be of sufficient length L to tuck securely between the legs when the wearer is seated upon a motorcycle.

FIGS. 4 shows a shape of the garment body 50 surface 12 that will shield the groin and inner thigh areas from wind and wet weather. FIG. 5 shows the same shape of the garment body 50 surface 14 which will insulate the groin and inner thigh areas from cold, wind and wet weather. Decorative or simple fasteners 20 are shown as indicated to provide greater strength and durability of structure.

FIG. 6 A second embodiment of the protective garment 30 is shown in FIG. 6. Appendages 22 of the same construction as the garment body 50, are attached to the garment body 50 by fasteners such as decorative or simple rivets as indicated at 20. It is not intended to limit the invention to any specific forms of body. The operation of this structure is such that the wearer of loose fitting chaps may tuck appendages 22 inside the upper thigh area of such chaps. This will provide greater warmth protection from cold, wind, and wet weather. The appendages 22 further stabilize the garment in place when worn with loose fitting chaps while riding.

The entire protective garment 30 shall be treated with an appropriate water resistant substance. The adhesive, cement or glue 13 used between outer surface 12 and inner surface 14 will provide still greater water repellence. The protective garment 30 in either embodiment is simple to construct, can be inexpensively manufactured and functions without material structural changes to receiving clothing. When used with chaps, the garment 30 need never be detacted if so desired. The protective garment 30 will be slideable upon a conventional belt or chaps belt so that the wearer can quickly and easily adjust the horizontal position of the garment.

SUMMARY, RAMIFICATIONS AND SCOPE

The reader will see that the protective loincloth garment 30 in either embodiment provides a durable, detechable, comfortable, flexible, water resistant, insulated, aesthetic groin protector for outerwear. The garment effectively and securely shields and insulates the sensitive groin and inner thigh areas from cold, wind, and wet weather. This prevention of undue chill and stress, which cause fatigue and inattention, will allow motorcyclists to drive more cautiously and safely during cold, damp or more hazardous weather conditions.

The protective loincloth garment 30 in either embodiment is easily partially or fully detachable when the wearer attends the toilet, when buckling or unbuckling chaps or belt, or when weather permits. The decorative or simple fastenings 16–18 allow the suspensory straps 10 to be easily adjusted on a belt or belt loops for a secure fit thereupon. The protective garment 30 in either embodiment will be slideable upon a conventional belt or chaps belt so that the wearer can quickly and easily adjust the horizontal position of the garment.

While my above description contains many specificity's, these should not be construed as limitations on the scope of the invention, but rather as an exemplification of preferred embodiments thereof. Many other variations are possible.

For example, the protective garment could include pockets with or without fastening or closure. Decorative fasteners could be applied at pocket, rivets and at other fastenings or closures. Non-functional embellishments such as conches could be applied on the garment body, appendages or suspensory straps. Various colored leathers could be used, as well as various shearlings or furs.

It is obvious that various materials resistant to wind and water may be used, and there are a plethora of insulation materials that may be functional. Accordingly, the scope of the invention should not be limited by the embodiments illustrated, but by the appended claims and their legal equivalents.

There are no protective outerwear garments that securely shield and insulate the groin and inner thigh areas from cold, wind, and wet weather. This garment addresses an existing need and solves a potentially serious problem which has never, to my knowledge, been addressed or for which solutions have been hitherto completely unrecognized. This invention has been described in its presently contemplated best mode. It is clear that it is susceptible to numerous modifications, modes and embodiments within the ability of those skilled in the art and without exercise of the inventive faculty. Accordingly, the scope of this invention is defined by the scope of the following claims:

I claim:

1. A protective loincloth shield for motorcycle riders of a generally triangular shape to cover and conform to the frontal area of a wearer's body below the waist and between the legs of a wearer; said shield having an upper edge, a left side edge and a right side edge; said shield being constructed of outer, intermediate and inner layers of material said outer layer being flexible water resistant and wind-breaking material; said inner layer being insulating material for contact with the wearer's outer garment and said intermediate layer being a water resistant adhesive layer bonding said inner and outer layers together; a plurality of suspensory means located along an upper edge of the shield and from which the shield depends; and a plurality of fastening means on the suspensory means for the suspension of the shield from a wearer's outer garment; at least one fastener located on each of the left and right side edges for structural strength and for the attachment of appendages for providing additional shielding to the wearer's body and wherein the entire shield is covered with a water resisting substance to protect the material shield from inclement weather.

2. A protective loincloth shield as claimed in claim 1 wherein said suspensory means attached along the upper edge of the shield are at least two straps; each strap having one end attached to the upper edge of the shield with one component of a fastener and wherein the other end of the strap hangs freely and has attached thereto the complementary component of the fasteners whereby the shield is suspended from a wearer's outer garment by threading the strap through a loop on the wearer's garment and fastening the fastener components together.

3. A protective loincloth shield as claimed in claim 2 wherein each end of the straps that hang freely include multiple fastener components to provide adjustability to the attachment of the shield to the wearer's garment.

4. A protective loincloth shield as claimed in claim 1 including appendages attached to the fasteners located on each of the left and right side edges, said appendages are constructed of an outer water resistant and wind resistant layer, an intermediate water resistant adhesive layer and an inner insulating layer bonded together and with a fastener component attached to the upper edge for attachment to the loincloth protector.

5. A protective loincloth shield as claimed in claim 4 wherein the appendages are covered with a water resisting substance to protect the material layers from inclement weather.

* * * * *